United States Patent [19]

Holland-Letz

[11] 4,358,333

[45] Nov. 9, 1982

[54] APPARATUS FOR PRINTING, DISPENSING AND APPLYING PRESSURE-SENSITIVE LABELS ADHERING TO A CARRIER TAPE

[75] Inventor: Günter Holland-Letz, Hirschhorn, Fed. Rep. of Germany

[73] Assignee: Esselte Pendaflex Corporation, Garden City, N.Y.

[21] Appl. No.: 239,371

[22] Filed: Mar. 2, 1981

[30] Foreign Application Priority Data

Mar. 6, 1980 [DE] Fed. Rep. of Germany ..... 3008642
Feb. 5, 1981 [DE] Fed. Rep. of Germany ..... 3104035

[51] Int. Cl.[3] ..... B65C 11/02

[52] U.S. Cl. ..... 156/384; 101/288; 156/541; 156/577; 156/579; 156/584; 156/DIG. 48; 156/DIG. 49

[58] Field of Search ..... 156/384, 541, 577, 579, 156/584, DIG. 48, DIG. 49; 101/287, 288, 291, 292

[56] References Cited

U.S. PATENT DOCUMENTS 4,053,345 10/1977 Hamisch, Jr. ..... 156/384
4,204,902 5/1980 Hamisch, Jr. ..... 156/384
4,267,006 5/1981 Karn et al. ..... 156/384

*Primary Examiner*—Michael G. Wityshyn
*Attorney, Agent, or Firm*—Gerald J. Ferguson, Jr.; Joseph J. Baker; C. Lamont Whitham

[57] ABSTRACT

In an apparatus for printing, dispensing and applying pressure-sensitive labels adhering to a carrier tape said carrier tape is drawn by a feed means stepwise about a peel edge which is formed by a roller mounted on a shaft and at which the pressure-sensitive labels are detached from the carrier tape. To achieve a clean peeling of the pressure-sensitive labels the peel edge must form as sharp an edge as possible which means that the rollers must have the smallest possible diameter and consequently must be mounted on a very thin shaft.

To enable rollers of small diameter to be used and nevertheless minimize the effects of the frictional moment between rollers and shaft, the shaft carrying the rollers is supported between its ends.

5 Claims, 4 Drawing Figures

APPARATUS FOR PRINTING, DISPENSING AND APPLYING PRESSURE-SENSITIVE LABELS ADHERING TO A CARRIER TAPE

BACKGROUND AND SUMMARY OF INVENTION

The invention relates to an apparatus for printing, dispensing and applying pressure-sensitive labels adhering to a carrier tape comprising a feed means which draws the carrier tape stepwise round a peel edge which is formed by a roller mounted on a shaft and at which the pressure-sensitive label is detached from the carrier tape and moves into a dispensing position.

Such an apparatus is known from US-PS 3,954,545. In this known apparatus a label can be brought into the dispensing position by first squeezing and then releasing a hand lever. During the squeezing of the lever the label in the apparatus is imprinted, for example with a price, an article number or the like, and on release of the lever the feed means engages the carrier tape and pulls it a length corresponding to the label length round the peel edge. On pulling of the carrier tape round the peel edge the label detaches and moves into the dispensing position beneath the applicator roll. The return of the lever to its starting position is under the action of a spring which must be strong enough to effect transport of the carrier tape. In particular, it must overcome the frictional forces which occur when the carrier tape is pulled round the peel edge. In the known apparatus as peel edge a stationary shaft provided with rollers is employed so that only the friction between the roller inner surfaces and the shaft peripheral surface acts against the pulling of the carrier tape round the peel edge. To ensure that the label detaches cleanly from the carrier tape at the peel edge said edge must be made as sharp as possible. This means that with the specific form of the peel edge outlined above the rollers must have the smallest possible external diameter. Said rollers must be mounted on a correspondingly thin shaft so that there is a danger of the shaft bending under the action of the tensile force exerted on the carrier tape. When this bending occurs the carrier tape is subjected to increased stress at the edges which can even lead to tearing of said carrier tape. The result of such tearing is that the carrier tape must be rethreaded into the apparatus and this represents an undesirable loss of time. The danger of this bending increases of course with increasing width of the labels for which the apparatus is designed.

Although this disadvantage could be compensated by using a shaft of larger diameter for a given roller external diameter the increase in the shaft diameter increases the effect of the frictional moment on the tensile force to be applied for advancing the carrier tape. The effect of the frictional moment on the tensile force is smaller the smaller the shaft diameter for a given roller external diameter.

This disadvantage cannot be obviated by using a shaft of greater diameter because this would impair the clean detachment of the label from the carrier tape.

The problem underlying the invention is to construct an apparatus of the type outlined above in such a manner that independently of the label width rollers of small diameter can be used for obtaining a sharp peel edge and nevertheless the effects of the frictional moment between rollers and shaft are kept small.

This problem is solved according to the invention in that the shaft carrying the rollers is supported between its ends.

Due to the supporting according to the invention of the shaft carrying the rollers said shaft can be made very thin compared with the roller diameter without any danger of said shaft sagging or bending under the influence of the tensile force exerted on the carrier tape. The same small shaft diameter can be used for any label width since if necessary several supports may be provided along the shaft. The carrier tape is stressed in all cases at the peel edge uniformly over its entire width so that there is no danger of the tape tearing. Also, due to the use of a thin shaft the external diameter of the rollers may be kept small so that a peel edge of small radius of curvature is obtained which guarantees good detaching of the pressure-sensitive labels from the carrier tape without the tape feed being impaired by the frictional moment between the rollers and shaft.

PREFERRED EMBODIMENTS

Figure 1:
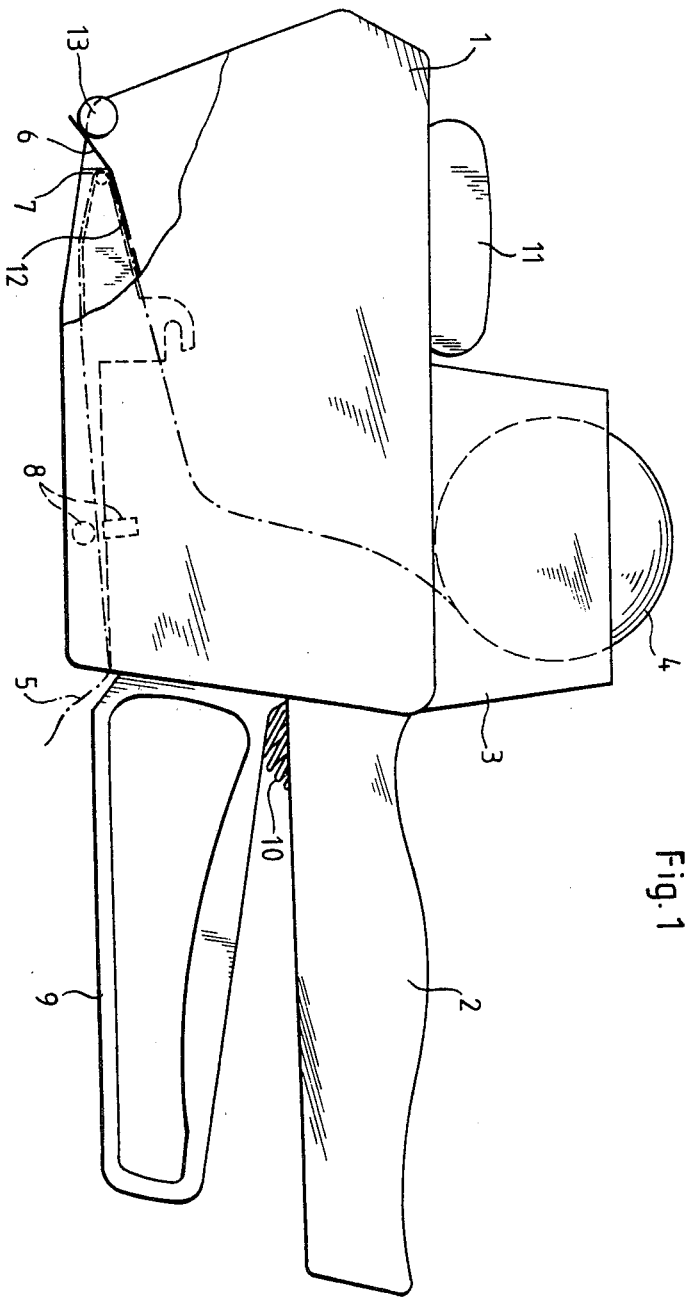
FIG. 1 is a very simplified side view of the apparatus made according to the invention, part of a side wall being removed.

The labelling apparatus illustrated in FIG. 1 comprises a housing 1 with a grip 2. At the top of the housing there is a well 3 for receiving a supply roll 4 comprising a carrier tape 5 and pressure-sensitive labels 6 adhering thereto. The carrier tape with the pressure-sensitive labels runs in the apparatus from the supply roll 4 downwardly and forwardly to a peel edge 7, from whence the carrier tape 5 extends under sharp deflection past a feed means 8 to the rear end of the housing. The path outlined is shown in dash-dot line in FIG. 1. Beneath the grip 2 is a hand lever 9 which can be squeezed against the grip 2 against the action of a spring 10. On squeezing the hand lever 9 a printing mechanism 11 is pivoted against a platen 12 so that an imprint is produced on the label which happens to be on the platen. At the same time the feed means 8 is moved one label length forwardly, i.e. to the left in the illustration of FIG. 1. During this forward movement the feed means 8 is not in engagement with the carrier tape 5. When released the hand lever 9 is returned by the spring 10 to its starting position. This also effects return of the printing mechanism 11 to its starting position and a movement of the feed means 8 by one label length rearwardly; since the feed means and the carrier tape are now in engagement this movement draws the carrier tape rearwardly by one label length. On this movement of the carrier tape the pressure-sensitive label just imprinted detaches from the carrier tape at the peel edge and moves into a dispensing position beneath an applicator roll 13 disposed at the front end of the apparatus. By rolling engagement of the applicator roll 13 the pressure-sensitive label 6 can now be adhered to an article.

Figure 2:
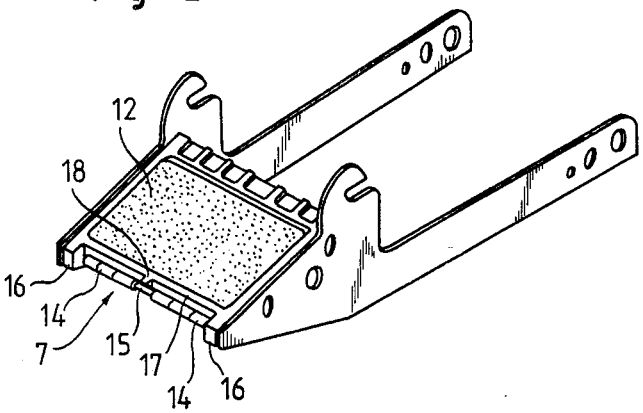
FIG. 2 is a perspective illustration of the peel edge carrier.

FIG. 2 illustrates a perspective view of the peel edge carrier disposed at the lower side of the housing 1 and carrying at the same time the platen 12. As is apparent the peel edge 7 is formed by a plurality of rollers 14 which consist of plastic and which are mounted on a shaft 15 of steel. The ends of the shaft 15 are held by two arms 16 which are connected together by a web 17. The platen is also disposed on said web. As apparent in FIG. 2 on the web 17 a support nose 18 is formed on which the shaft 15 bears. The side of the support nose 18 facing the shaft 15 is formed so that it partially surrounds the shaft 15.

Figure 3:
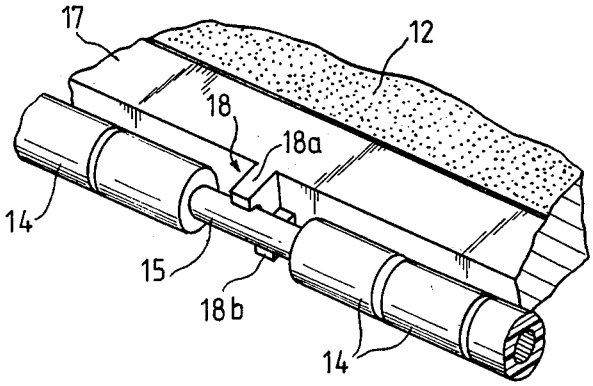
FIG. 3 is a greatly enlarged fragment of the illustration of FIG. 2 showing the support region of the shaft carrying the rollers.
Figure 4:
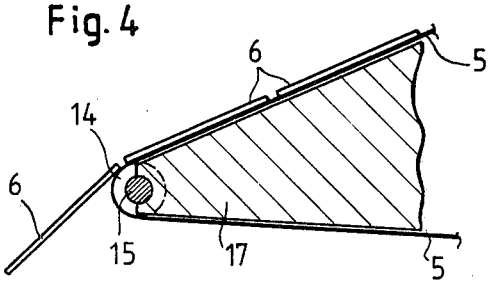
FIG. 4 is a partial section extending through the support nose and the web of the peel edge carrier with the label carrier tape guided therearound.

In FIG. 3 the support nose 18 is illustrated more clearly. It comprises two halves 18*a* and 18*b* which are offset laterally in the axial direction with respect to each other and on which the shaft 15 bears. This special form of the support nose is chosen because it simplifies the production of the plastic part forming the web 17. In this manner, on the plastic member made by injection moulding the formation of an undercut to receive the shaft 15 is avoided so that the injection mould can be easily separated.

Because of the supporting of the shaft 15 even with wide labels bending of the shaft is prevented and as a result the stresses acting on the carrier tape at the peel edge are distributed uniformly over the entire tape width. There is therefore no danger of the carrier tape tearing because of irregular stressing.

In an apparatus which operates with very wide labels a plurality of support noses on which the shaft 15 is supported may be provided on the web 17 of the peel edge carrier.

Due to the supporting of the shaft 15 for any label width the shaft diameter may be reduced to 0.6 mm. With this small diameter, without impairing the frictional moment between rollers and shaft correspondingly small rollers may be used so that a relatively "sharp" peel edge is formed at which even at relatively high feed rates of the carrier tape the labels are reliably detached and move into the dispensing position beneath the applicator roll. The labels exhibit no tendency to fold back at the dispensing edge. This favourable behaviour can be achieved with the dimensions mentioned even when using a relatively cheap carrier tape to which the labels adhere more firmly due to a lower siliconising of the carrier tape surface.

Polyamide has been found particularly favourable as material for the rollers 14.

The diameter of the shaft 15 may be further reduced if as material for the shaft and rollers materials are used which are more resistant to wear than the aforementioned materials. If for example for the shaft 15 tungsten or hardened steel is used and as roller material ruby is employed the shaft diameter can easily be reduced beneath the aforementioned value of 0.6 mm. Since as already mentioned at the beginning the effect of the frictional moment on the tensile force to be exerted on the carrier tape is smaller the smaller the shaft diameter for a given roller external diameter, this possibility of further reducing the shaft diameter is very advantageous. Whilst maintaining a relatively sharp peel edge, i.e. with an unchanged external diameter of the rollers 14, by reducing the shaft diameter it is possible to further reduce the influence of the frictional moment on the tensile force if the aforementioned materials more resistant to wear are employed.

To reliably prevent a bending or sagging of extremely thin shaft 15 of tungsten or hardened steel the shaft is supported several times using support noses 18 of the type illustrated in FIG. 3.

What we claim is:

1. Apparatus for printing, dispensing and applying pressure-sensitive labels adhering to a carrier tape comprising a feed means which draws the carrier tape stepwise round a peel edge which is formed by rollers mounted on a shaft and at which the pressure-sensitive label detaches from the carrier tape and moves into a dispensing position, wherein the shaft carrying the rollers consists of tungsten or hardened steel and is supported between its ends.

2. Apparatus as defined in claim 1 wherein the ends of the shaft are held in two spaced apart arms connected by a web and on the web at least one support nose engaging the shaft is formed.

3. Apparatus as defined in claim 2 wherein the dimensions of the support nose within the engagement region are smaller than the diameter of the rollers.

4. Apparatus as defined in claim 3 wherein the side of the support nose facing the shaft is formed so that it partially surrounds said shaft.

5. Apparatus as defined in any one of the preceding claims wherein the rollers consist of ruby and the shaft is supported several times between its ends.

* * * * *